US006117023A

United States Patent [19]

Onuki et al.

[11] Patent Number: 6,117,023

[45] Date of Patent: Sep. 12, 2000

[54] GOLF CLUB HEAD

[75] Inventors: Masahide Onuki, Miki; Tetsuo Yamaguchi, Nishinomiya, both of Japan

[73] Assignee: Sumitomo Rubber Industries, Ltd., Kobe, Japan

[21] Appl. No.: 09/131,779

[22] Filed: Aug. 10, 1998

[30] Foreign Application Priority Data

Aug. 19, 1997 [JP] Japan ..... 9-238939

[51] Int. Cl.[7] ..... A63B 53/04

[52] U.S. Cl. ..... 473/342; 473/324

[58] Field of Search ..... 473/379, 342, 473/345, 340, 324, 350, 335, 348, 349

[56] References Cited

U.S. PATENT DOCUMENTS 5,816,936 10/1998 Aizawa et al. ..... 473/342

FOREIGN PATENT DOCUMENTS 5-337222 12/1993 Japan .
6-165843 6/1994 Japan .
6-182006 7/1994 Japan .
7-255884 10/1995 Japan .
8-252344 10/1996 Japan .

*Primary Examiner*—Kien T. Nguyen
*Attorney, Agent, or Firm*—Armstrong, Westerman, Hattori, McLeland & Naughton

[57] ABSTRACT

A golf club head provided with a head main body, and a face body fitted to a concave portion of the head main body. A caulking member is press-fitted into an aperture between an inner peripheral surface of the concave portion of the head main body and a peripheral surface of the face body, and the head main body and the face body are connected and fixed by plastic deformation of the caulking member. A contact area for positioning the face body, where the peripheral surface of the face body and the inner peripheral surface of the concave portion of the head main body directly contact, is arranged on at least a part of the concave portion.

15 Claims, 18 Drawing Sheets

GOLF CLUB HEAD

BACKGROUND OF THE INVENTION

1. Field of the Invention

This invention relates to a golf club head.

2. Description of the Related Art

Conventionally, as methods for fixing a golf club head main body and a face body which is fitted to a concave portion of a face side of the head main body, techniques of ① through ⑤ do described below are known.

① Japanese Patent Provisional Publication No. 6-165843 discloses a golf club head in which a face body is fixed to a head main body through metal members for connection.

② Japanese Patent Provisional Publication No. 6-182006 discloses a golf club head in which a concave portion is formed on a face body, a convex portion which fits to the concave portion is formed on a head main body with plastic deformation, and the face body is fixed to the head main body.

③ Japanese Patent Provisional Publication No. 5-337222 discloses a golf club head in which a peripheral face of a concave portion of a head main body to which a face body is attached is formed with a reverse-tapered configuration as to be wider at a back side, and the face body is press-fitted to the concave portion with plastic deformation and fixed to the head main body.

④ Japanese Patent Provisional Publication No. 7-255884 discloses a golf club head in which pins are applied to a concave portion of a head main body to which a face body is fitted, pin holes where the pins go through are disposed on the face body, and the face body is fixed to the head main body with caulking the pins.

⑤ Japanese Patent Provisional Publication No. 8-252344 discloses a golf club head in which a caulking member is applied to an aperture between an inner face of a concave portion of a head main body and a circumference of a face body, and the face body is fixed to the head main body with plastic deformation of the caulking member.

In recent years, golf clubs in which dissimilar (different) metals are combined have been attracting public attention. As effects of using dissimilar metals, increase of degree of freedom in weight distribution, efficient use of small amount of expensive materials (such as titanium alloy etc.), proper selection of materials corresponding to requirement characteristics of each part of a head (strength, rigidity, wear rate etc.), and external beauty, are thinkable. To realize a combination head made of dissimilar metals as described above, various methods for fixing a face body to a head main body have been proposed as described above.

Problems described below, however, still remain unsolved.

That is to say, in case that titanium alloy, which is attracting attention as a head material, is used for a head main body or a face body, and a material which is difficult to be worked plastically (such as pure titanium, tungsten, ceramic, amorphous metal, etc.) is used for the other, it is difficult to fix the face body to the head main body by fixing methods with plastic deformation shown in above described ② and ③. Because titanium and titanium alloy have high deformation resistance in plastic deformation, bad dimension accuracy for their high spring back, and are considerably difficult to be worked plastically in comparison with conventional materials. And if titanium and titanium alloy are forced to be fixed with plastic deformation (caulking), gaps may be generated by relieves of caulked parts.

In fixing methods of ① and ④, a face body can be fixed to a head main body when they are made of materials which is difficult to be plastically deformed, since the fixation is conducted with metal members for connection or pins. In these methods, however, number of parts increases for necessity of the metal members for connection, the pins, and the pin holes to which the pins are inserted. This increases parts preparation time and number of assemble processes, production efficiency becomes worse, and production cost becomes higher thereby.

In fixing methods of ⑤ in which the face body and the head main body are connected by plastic deformation of the caulking member applied to the aperture between the inner face of the concave portion of the head main body and the circumference of the face body (a face insert), although a head main body and a face body made of materials which are difficult to be plastically deformed can be fixed, following problems still remain.

That is to say, position of the face body moves, and an aperture between the inner peripheral surface of the head main body and the peripheral face of the face body becomes ununiform in peripheral direction with the plastic deformation of the caulking member in press working, because positioning of the face body to the head main body depends on the plastic deformation of the caulking member. And, in case that the caulking member is partially worked with plastic deformation with sequential move of press position, the face body is greatly dislocated and the aperture becomes extremely ununiform.

For this reason, it is necessary to deform the caulking member entirely at the same time, and a large press apparatus is required. However, it is difficult to deform the entire caulking member uniformly at the same time, even with a large press apparatus, and the dislocation of the face body conspicuously appears for ununiformity of pressure, etc.

And, another problem is that impact force when the club head hits a golf ball generates elastic deformation in the face body, and the club head is damaged by deformation and rubbing of the caulking member, of which material is easily deformed plastically, filling the aperture between the inner face of the concave portion of the head main body and the circumference of the face body. And, there is a further problem that gaps are generated between the caulking member and the face body (an insert body).

It is therefore an object of the present invention to provide a golf club head in which a head main body and a face body made of low plasticity materials can be fixed with high working efficiency by a small manufacturing apparatus. And, it is another object of the present invention to provide a golf club head which does not generate dislocation of the face body, even if the caulking member is worked with partial plastic deformation sequentially, and having beautiful finish, high fixation ability of the face body, and high durability.

BRIEF DESCRIPTION OF THE DRAWINGS

The present invention will be described with reference to the accompanying drawings in which.

DESCRIPTION OF THE PREFERRED EMBODIMENTS

Preferred embodiments of the present invention will now be described with reference to the accompanying drawings.

Figure 1:
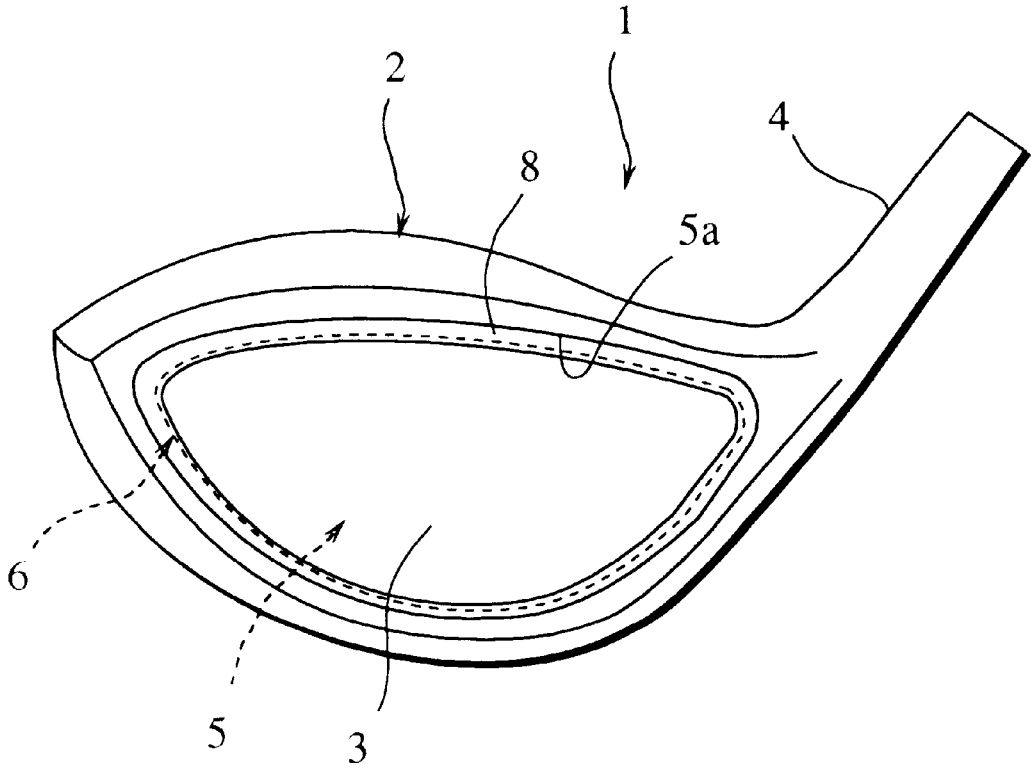
FIG. 1 is a front view showing an preferred embodiment of the present invention.
Figure 2:
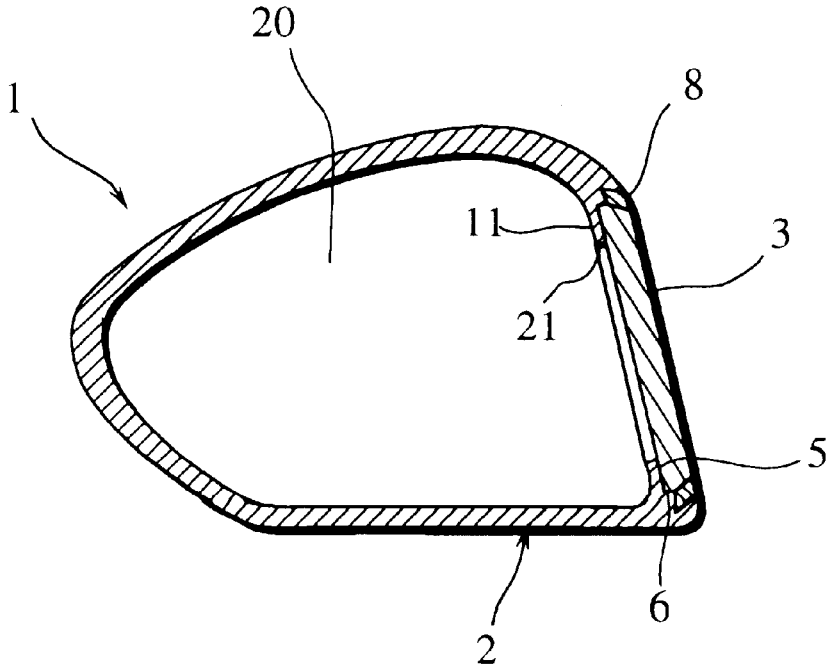
FIG. 2 is a cross-sectional view showing an preferred embodiment of the present invention.
Figure 3A:
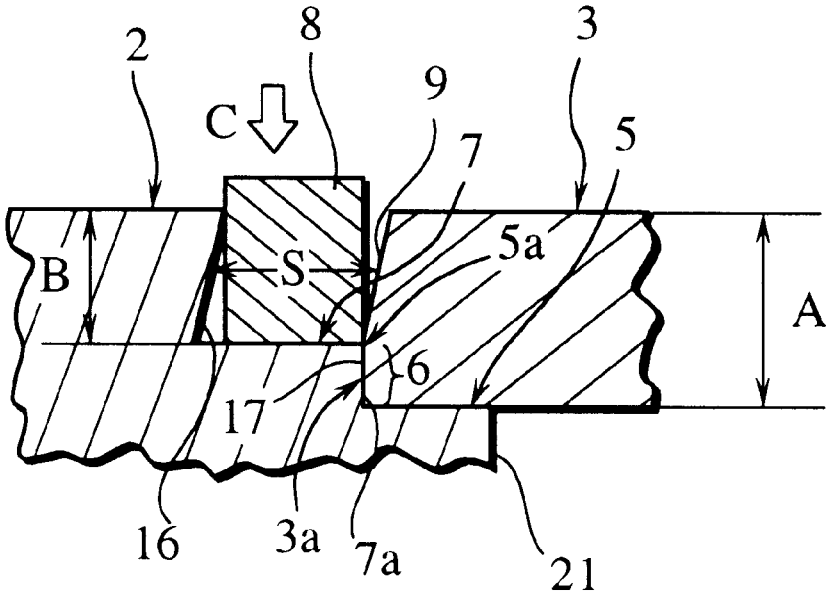
FIG. 3A is an explanatory cross-sectional view of an enlarged principal portion showing an preferred embodiment of the present invention.
Figure 3B:
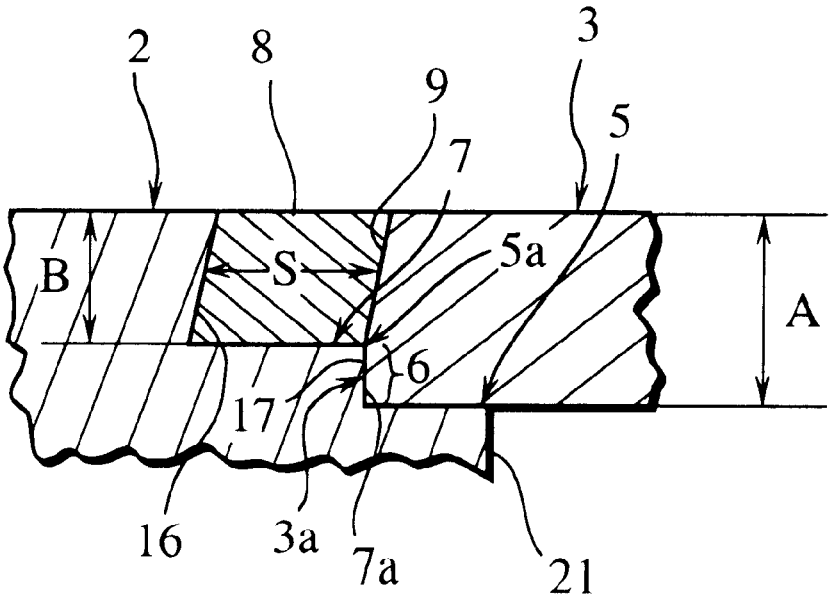
FIG. 3B is an explanatory cross-sectional view of an enlarged principal portion showing an preferred embodiment of the present invention.

FIG. 1 is a front view showing an embodiment of the present invention applied to a wood-type golf club head. FIG. 2 is a longitudinal section of the embodiment of FIG. 1. FIGS. 3A and 3B are explanatory cross-sectional views of an enlarged principal portion. And FIGS. 3A and 3B are explanatory views of manufacturing method at the same time.

As shown in FIG. 1 through FIG. 3B, in this golf club head 1, a face body 3 (a face plate) is fitted to a concave portion 5 formed on a face side of the head main body 2, a caulking member 8 is press-fitted into an aperture S between an inner peripheral surface 5*a* of a concave portion 5 of the head main body 2 and a peripheral surface 3*a* of the face body 3, and the head main body 2 and the face body 3 are connected and fixed with plastic deformation of the caulking member 8. The head main body and the face body are made of similar (same) or dissimilar (different) materials, and a neck portion 4, which is connected with a golf club shaft (not shown in Figures), is integrally formed with the head main body 2.

A contact area 6, where the inner peripheral surface 5*a* of the concave portion 5 of the head main body 2 and the peripheral surface 3*a* of the face body 3 directly contact, is arranged at least on a part of the concave portion 5 for positioning the face body 3. Concretely, (as shown in FIG. 2) a window portion 21, which opens to a hollow chamber portion 20, is formed on a face wall of the head main body 2. An inner brim portion 11 protrudes from an inner peripheral face of the window portion 21, and the former-described face body 3 is fitted to the shallow concave portion 5 of which bottom is the inner brim portion 11. And, the window portion 21 on the face wall may be omitted, and the concave portion 5 may be formed as to be an entirely closed shallow dish on an outer face of the face wall (not shown in Figures).

Further, as shown in FIGS. 3A and 3B, a stepped portion 7 is formed in the concave portion 5 along a periphery of the concave portion 5 all around, the peripheral surface 3*a* of the face body 3 contacts an inner face 7*a* of the stepped portion 7, and the contact area 6 is composed thereby. That is to say, the inner peripheral surface 5*a* of the concave portion 5 consists of the vertical inner face 7*a* of the stepped portion 7 and an aperture forming face 16 that is upper (outer) to the stepped portion 7 and inclined to an inner side of the concave portion 5.

Figure 9:
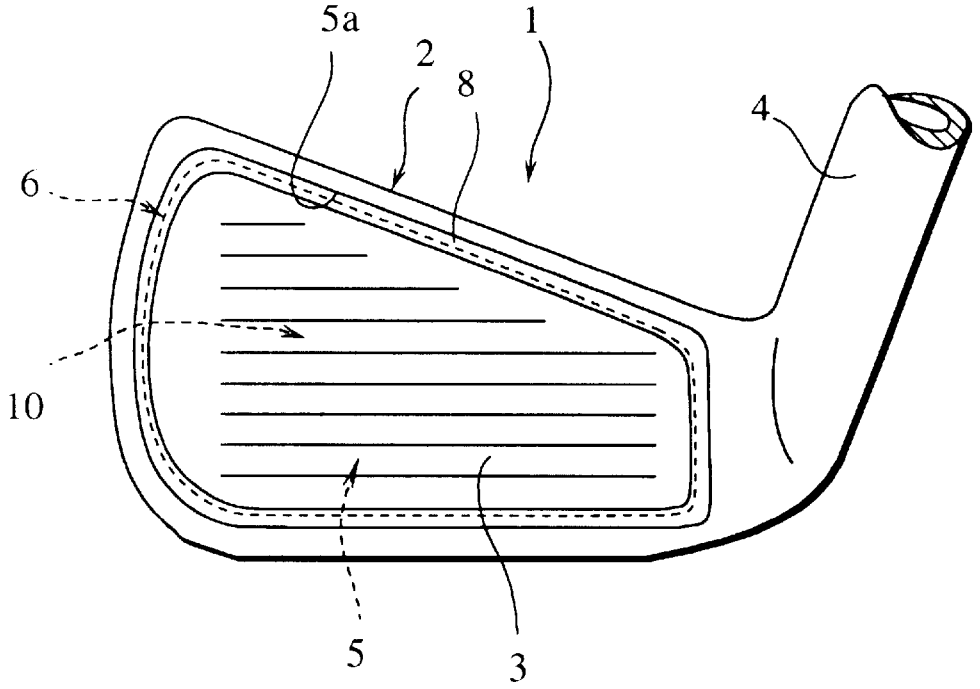
FIG. 9 is a front view showing another preferred embodiment of the present invention.
Figure 10:
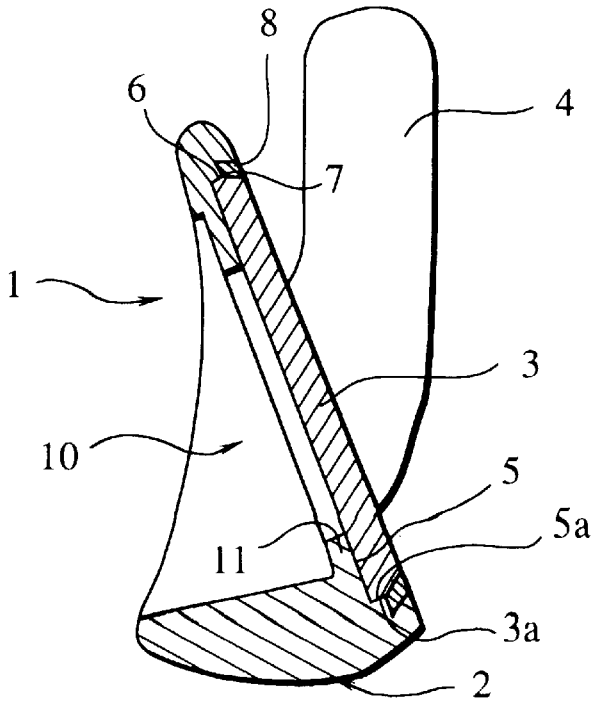
FIG. 10 is a cross-sectional view showing another preferred embodiment of the present invention.

Further, the present invention, of which application is not restricted to wood-type golf club heads, can be applied to iron-type golf club heads as another embodiment shown in FIG. 9 and FIG. 10.

In FIG. 9 and FIG. 10, parts of same marks representing same parts in FIG. 1 and FIG. 2 are similarly constructed as in a case of FIG. 1 and FIG. 2, and explanation of these parts is omitted. In this iron-type golf club head, a hollow portion 10, which goes through a face side and a back side of a head main body 2, is formed in the head main body 2, an inner brim portion 11 protrudes from an inner peripheral surface of the hollow portion 10, and a face body 3 fits to a shallow concave portion 5 of which bottom is the inner brim portion 11.

Figure 11:
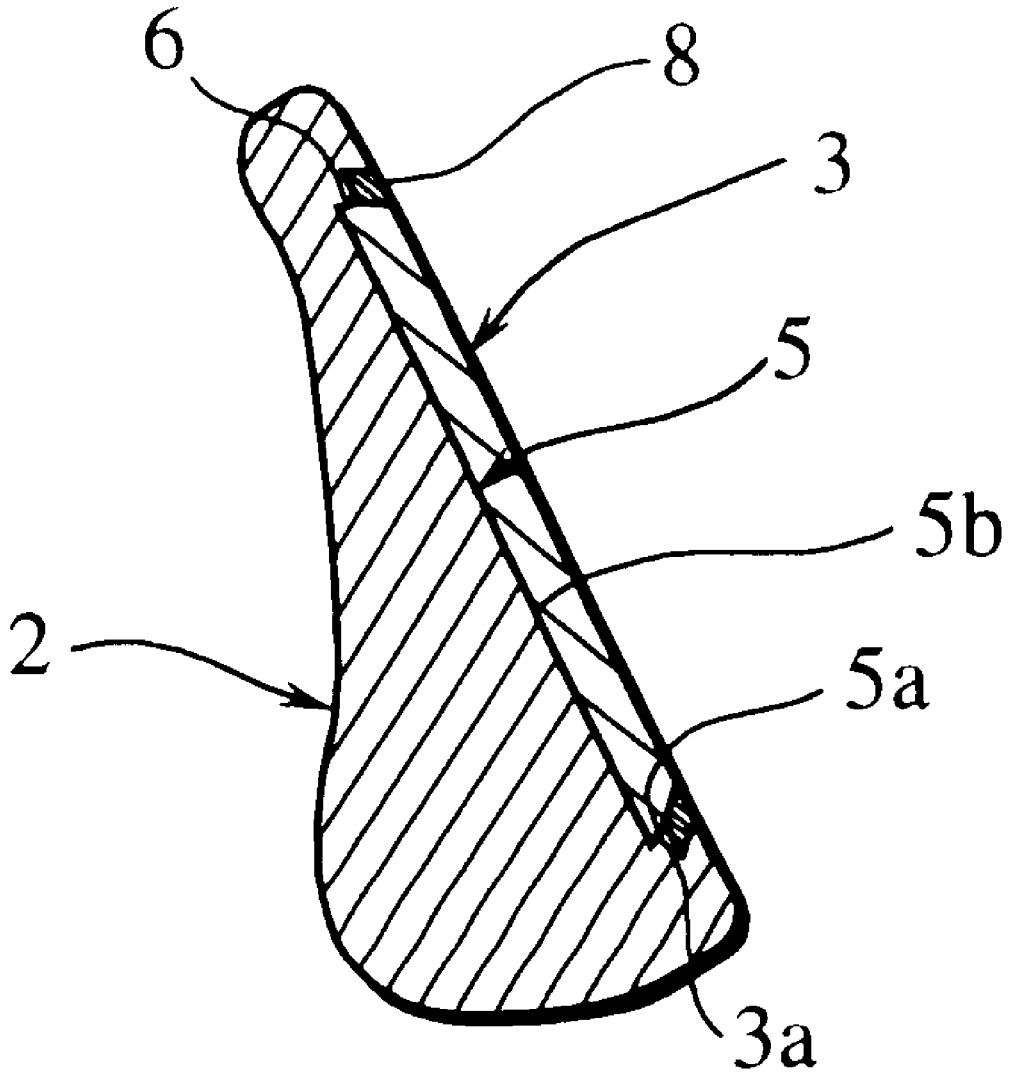
FIG. 11 is a cross-sectional view showing a modification example of the embodiment of FIG. 8.

As a modification example shown in FIG. 11, the concave portion 5 may be formed as to be a shallow dish of which bottom face 5*b* is entirely closed.

And, in FIG. 1 and FIGS. 3A and 3B, or in FIG. 9 and FIGS. 3A and 3B, the peripheral surface 3*a* of the face body 3 consists of a vertical face 17 touching the inner face 7*a* of the stepped portion 7 of the concave portion 5 of the head main body 2 and a chamfer 9 formed outer to the vertical face 17. The chamfer 9 inclines in the same direction of the aperture forming face 16 of the concave portion 5 of the head main body 2, and is a straight face parallel to the aperture forming face 16.

And, as a depth dimension B of the aperture S, which is set depending on a thickness dimension A of the face body 3, is arranged to be within a range of $0.3A \leqq B \leqq 0.7A$. Because if the depth dimension B is under the lower limit value, a holding part of the caulking member 8 that holds the face body 3 to prevent the face body 3 from falling is small, and fixation of the face body 3 becomes unstable. And, if the depth dimension B is over the upper limit value, depth of the contact area 6 becomes excessively small, and the positioning of the face body 3 becomes uncertain.

Next, press-fit plastic working of the caulking member 8 will be described. In FIG. 3A, the caulking member 8 of rectangle cross-section is placed in the aperture S, pressed in a direction of arrow C by a press machine, and worked with compression plastic deformation.

The caulking member 8 adheres to the aperture forming face 16 of the inner peripheral surface 5*a* of the concave portion 5 of the head main body 2 and the chamfer 9 of the face body 3 by the plastic deformation. Even if the plastic deformation is conducted with a method that press position is moved along the aperture S sequentially, relative dislocation of the face body 3 to the head main body 2 is not generated for the contact area 6 for positioning the face body 3.

Then, finishing works such as cutting are conducted on the face (needless raising of the caulking member 8 is ground away), and the golf club head becomes a state of finished product shown in FIG. 3B.

As clearly shown in FIG. 1 or FIG. 9, the contact area 6 for positioning the face body 3 is formed as to be a closed ring (loop) along the periphery of the concave portion 5.

Figure 12A:
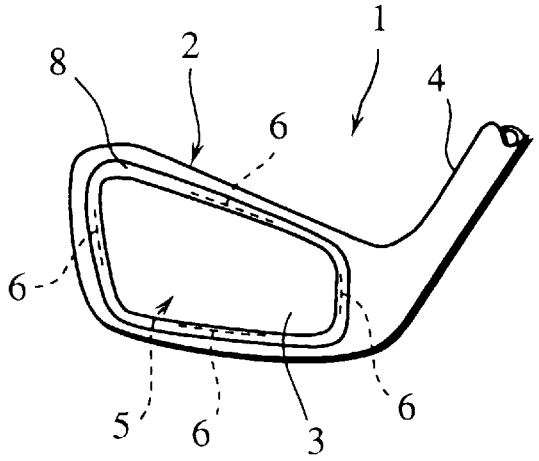
FIG. 12A is a schematic front view showing still another preferred embodiment of the present invention.
Figure 12B:
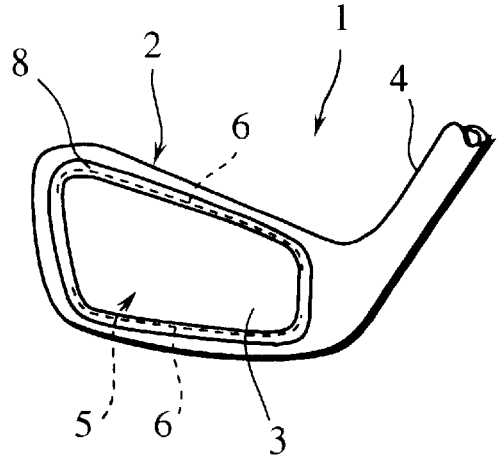
FIG. 12B is a schematic front view showing still another preferred embodiment of the present invention.
Figure 12C:
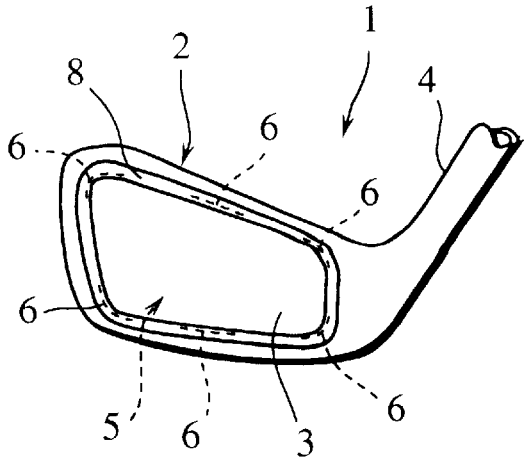
FIG. 12C is a schematic front view showing still another preferred embodiment of the present invention.

FIGS. 12A, 12B, and 12C show modification examples of the contact area 6, in which contact areas 6 are formed intermittently along the periphery of the concave portion 5. In FIG. 12A, for example, the contact areas 6 are disposed on a part of an upper side, a part of an lower side, a part of a toe side, and a part of a heel side of the concave portion 5. In FIG. 12B, the contact areas 6 are disposed mainly on a part of the upper side, and a part of the lower side of the concave portion 5. And in FIG. 12C, the contact areas 6 are disposed on four corners, a part of the upper side, and a part of the lower side of the concave portion 5.

Figure 13:
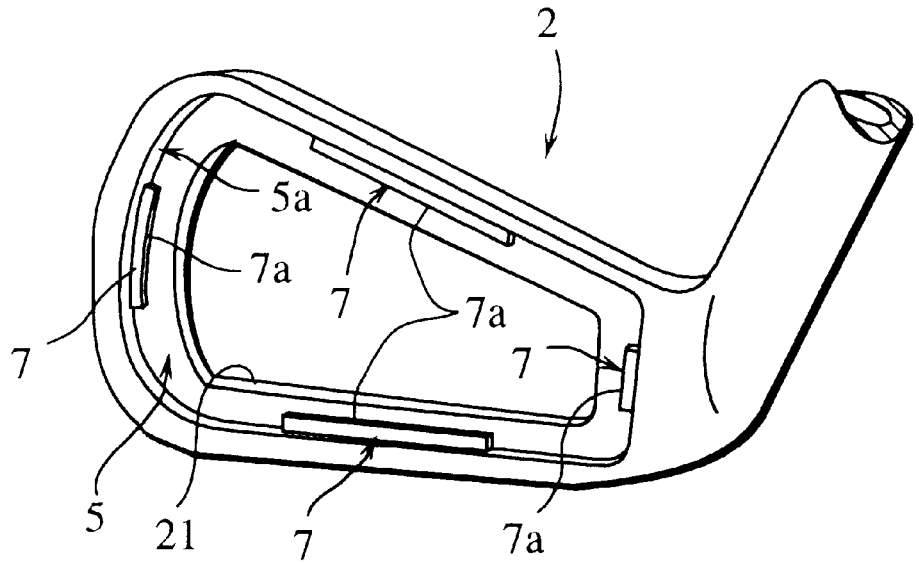
FIG. 13 is a perspective view of the head main body in a concrete example of still another preferred embodiment.
Figure 14:
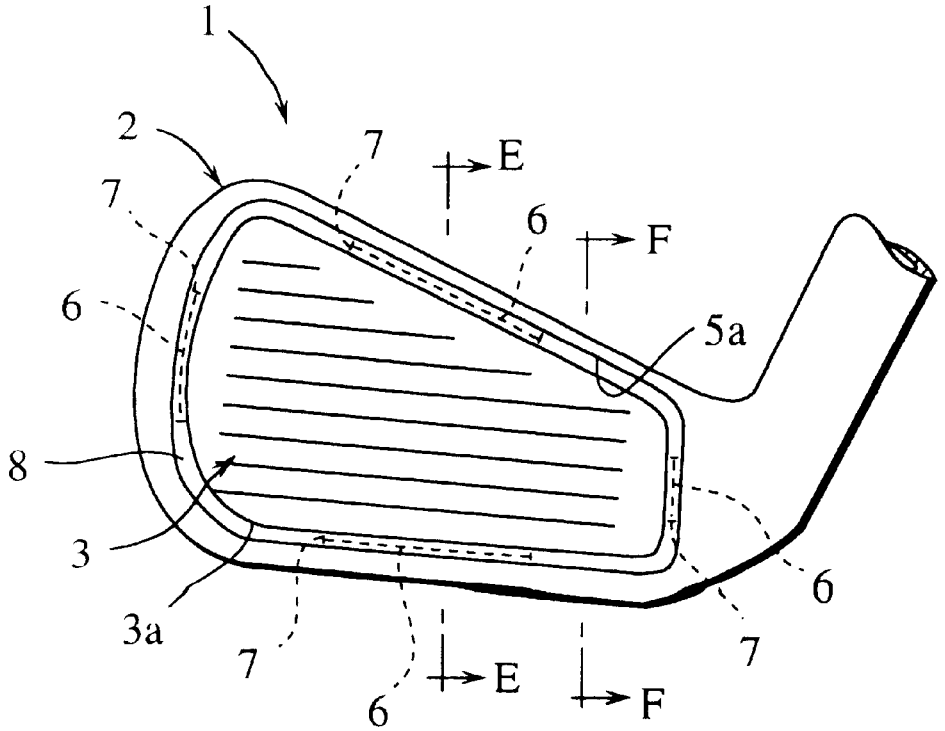
FIG. 14 is a front view of still another preferred embodiment.
Figure 15A:
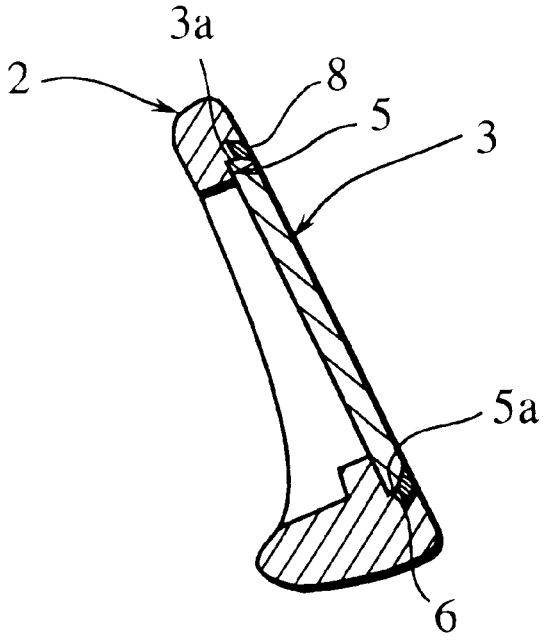
FIG. 15A is a cross-sectional view of still another preferred embodiment.
Figure 15B:
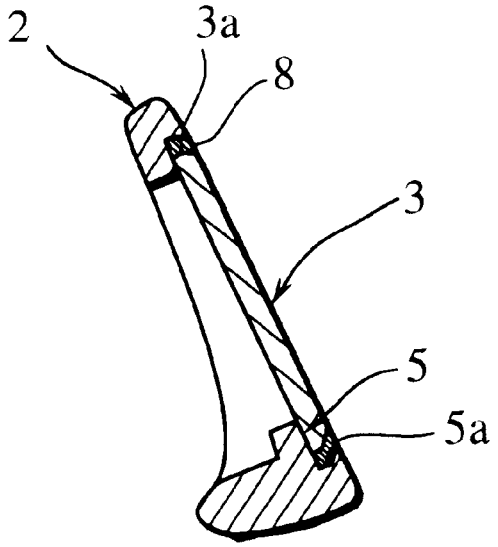
FIG. 15B is a cross-sectional view of still another preferred embodiment.
Figure 16:
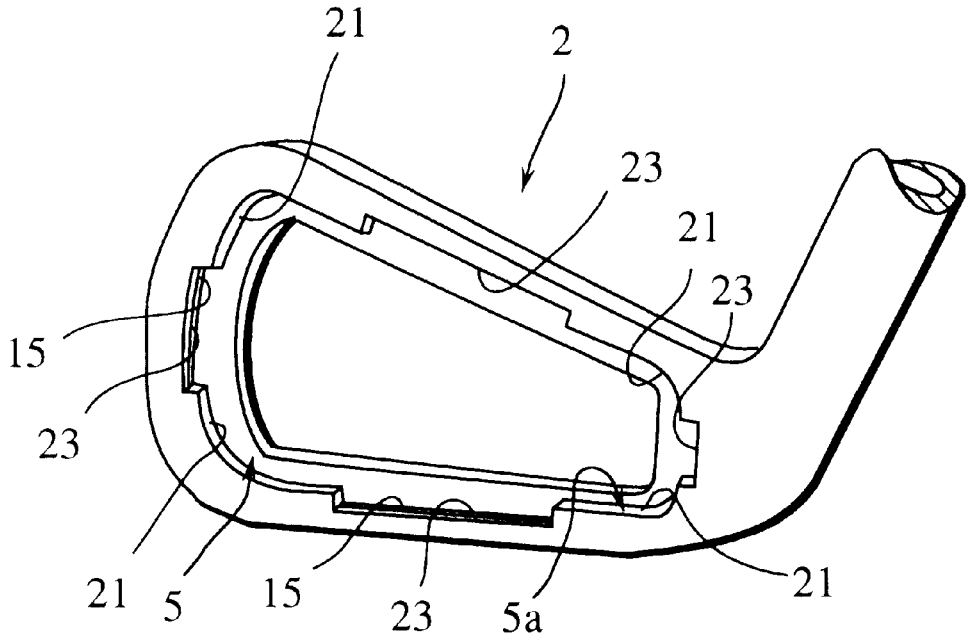
FIG. 16 is a perspective view of the head main body in a concrete example of a further preferred embodiment.

To dispose the contact areas 6 as shown in FIG. 12A, for example, the stepped portions 7 are formed along the periphery of the concave portion 5 of the head main body 2 of an iron-type head intermittently as shown in FIG. 13, the face body 3 is fitted to the concave portion of the head main body 2 as shown in FIG. 14 and FIGS. 15A and 15B, and then, the caulking member 8 is worked with press-fit plastic deformation. As a matter of course, the contact areas 6 may be disposed intermittently (or interruptedly) in other arrangements. FIG. 15A is a cross-sectional view of FIG. 14 at a line E—E, and FIG. 15B is a cross-sectional view of FIG. 14 at a line F—F.

Figure 4A:
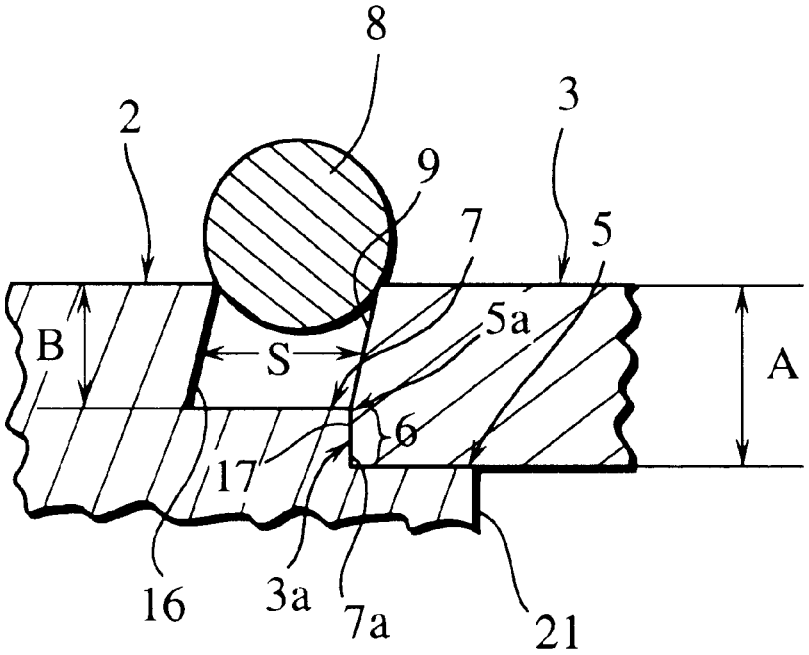
FIG. 4A is an explanatory cross-sectional view of an enlarged principal portion with modified cross-sectional shape of a caulking member.
Figure 4B:
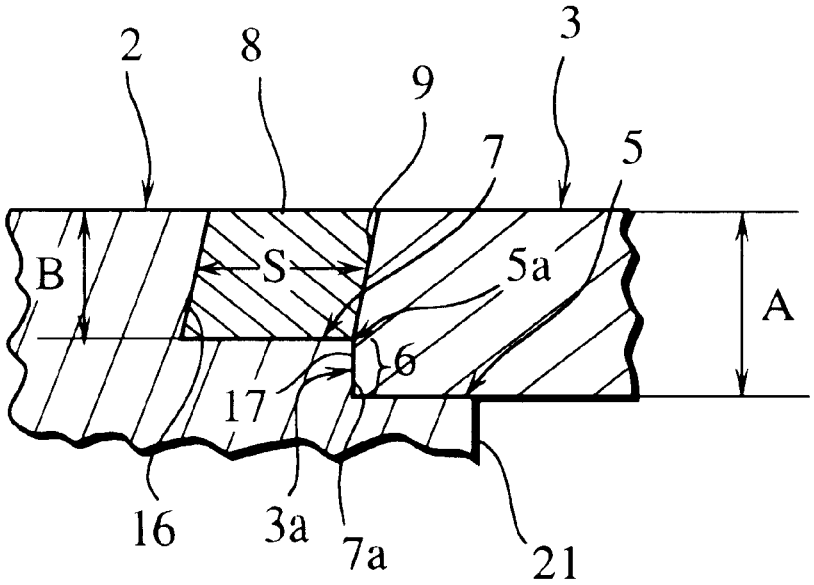
FIG. 4B is an explanatory cross-sectional view of an enlarged principal portion with modified cross-sectional shape of a caulking member.

Next, in FIGS. 4A and 4B, cross-sectional shape of the caulking member 8 before the press-fit plastic deformation is circular. Except for this, this embodiment is similar to the embodiment shown in FIGS. 3A and 36. In this manner, in case that press position is moved along the aperture S sequentially with a linear caulking member 8, working efficiency (fitting efficiency) is improved because it is unnecessary to pay attention to direction of the caulking member 8 in insertion to the aperture S, and an existing wire can be used as the caulking member 8.

Figure 5A:
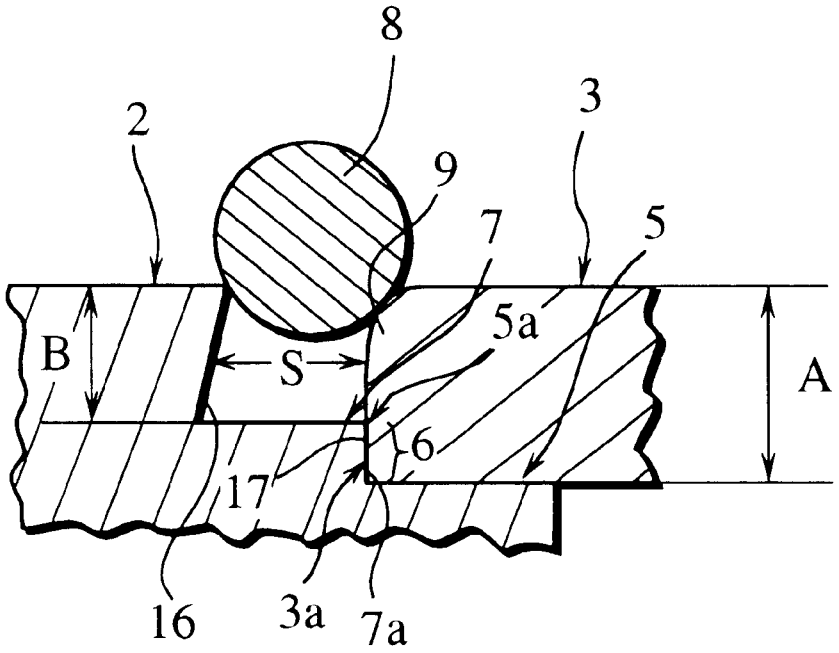
FIG. 5A is an explanatory cross-sectional view of an enlarged principal portion with modified cross-sectional shape of a face body.
Figure 5B:
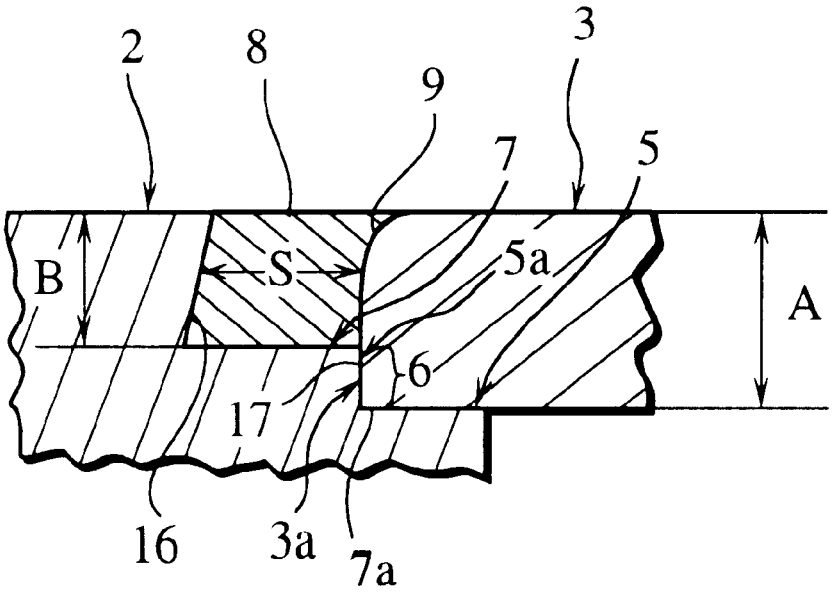
FIG. 5B is an explanatory cross-sectional view of an enlarged principal portion with modified cross-sectional shape of a face body.

Next, in FIGS. 5A and 5B, the chamfer 9 of the face body 3 is a round slope (or round chamfer), and the caulking member 8 is circular in cross section before the press-fit plastic deformation. Except for these, this embodiment is similar to the embodiment shown in FIG. 3A and 3B.

Figure 6A:
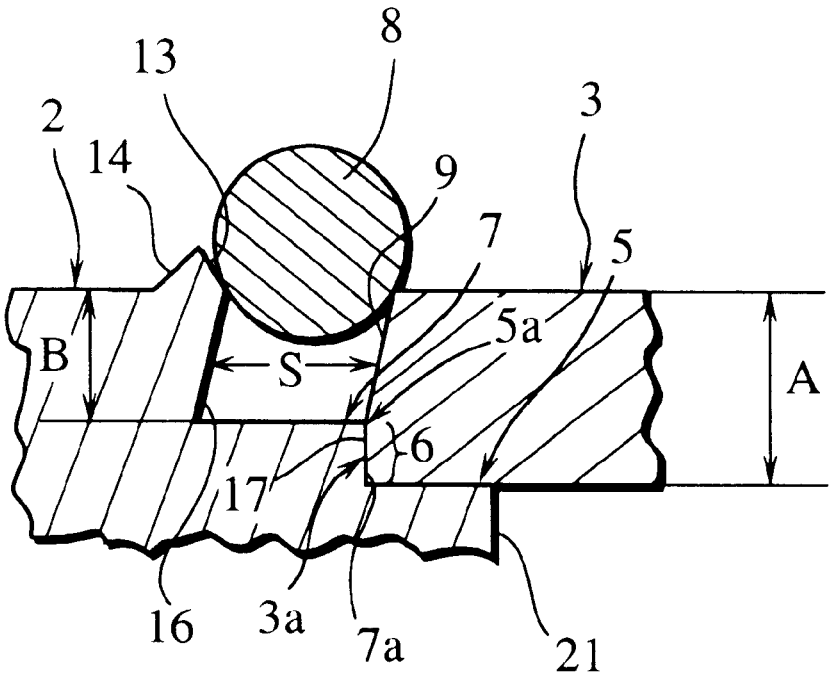
FIG. 6A is an explanatory cross-sectional view of an enlarged principal portion with modified cross-sectional shape of a head main body.
Figure 6B:
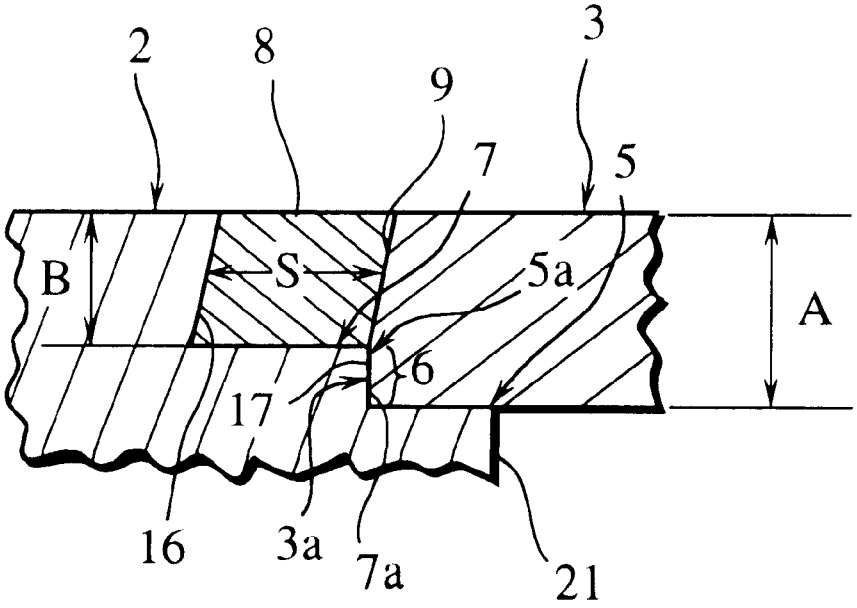
FIG. 6B is an explanatory cross-sectional view of an enlarged principal portion with modified cross-sectional shape of a head main body.

Next, in FIGS. 6A and 6B, the chamfer 9, which is straight same as in FIGS. 3A and 3B, is formed on the face body 3, and the caulking member 8 is circular in cross section same as in FIGS. 4A and 4B and FIGS. 5A and 5B. And a small protruding portion 14 having a guide slope 13 which leads the caulking member 8 is formed beforehand at an opening edge portion of the concave portion 5. In the finishing works such as cutting conducted after the press-fit plastic deformation (crush) of the caulking member 8, the small protruding portion 14 is removed together with the excessive protrusion of the caulking member 8, and this makes the golf club head as shown in FIG. 6B.

Figure 7A:
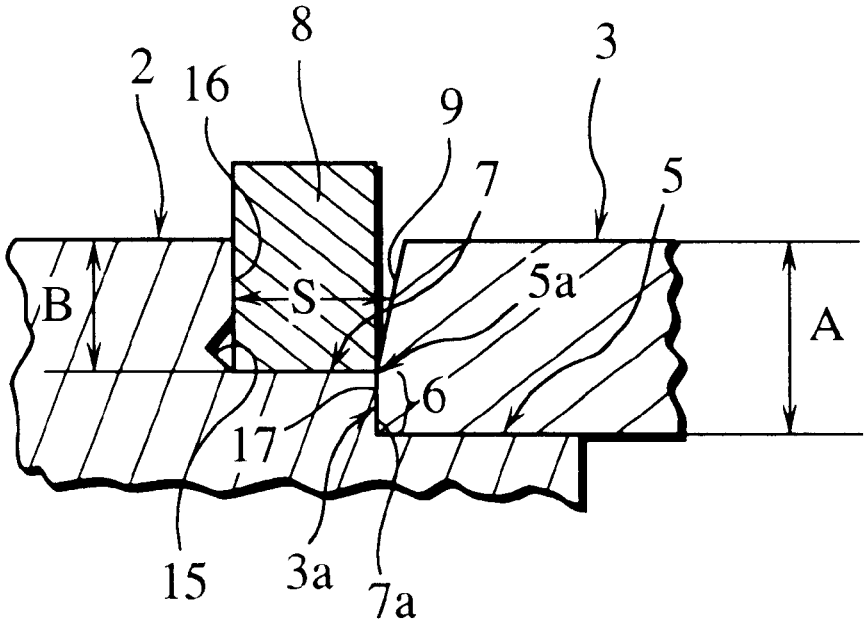
FIG. 7A is an explanatory cross-sectional view of an enlarged principal portion with a small concave groove portion on a head main body.
Figure 7B:
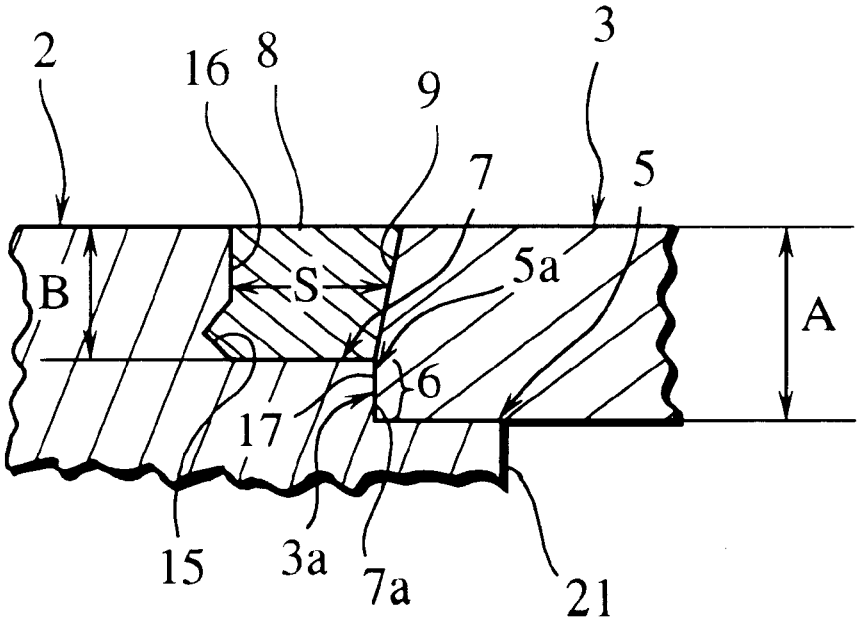
FIG. 7B is an explanatory cross-sectional view of an enlarged principal portion with a small concave groove portion on a head main body.

Next, although an embodiment shown in FIGS. 7A and 7B is basically same as the embodiment shown in FIGS. 3A and 3B, cross-sectional shape of the aperture forming face 16 is different. That is to say, instead of the aperture forming face 16 which is straight and inclined as shown in FIGS. 3A and 3B, a small concave groove portion 15 is formed on a lower portion of the vertical aperture forming face 16 in FIGS. 7A and 7B. That is to say, the small concave groove portion 15 that the caulking member 8 gets in is formed on the inner peripheral surface 5*a* of the head main body 2. This small concave groove portion 15 prevents the caulking member 8 from falling out of the aperture S.

Figure 8A:
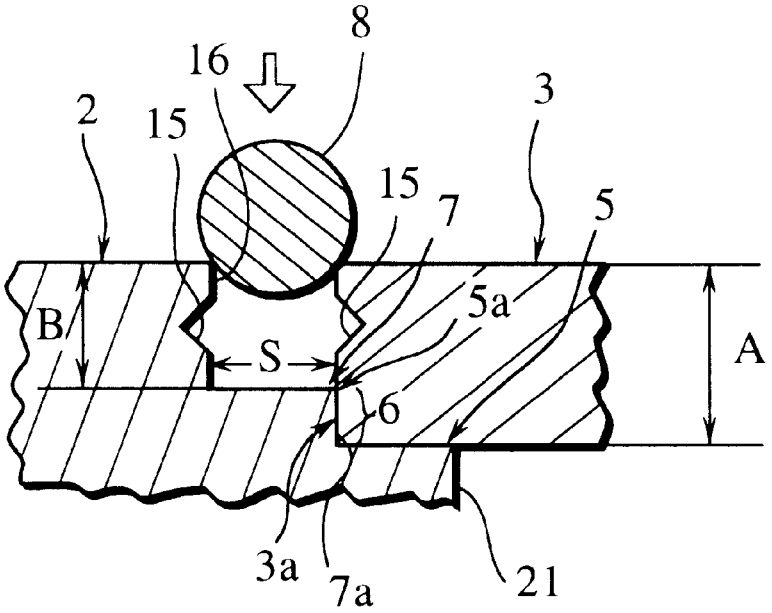
FIG. 8A is an explanatory cross-sectional view of an enlarged principal portion with a small concave groove portion on a head main body and a face body.
Figure 8B:
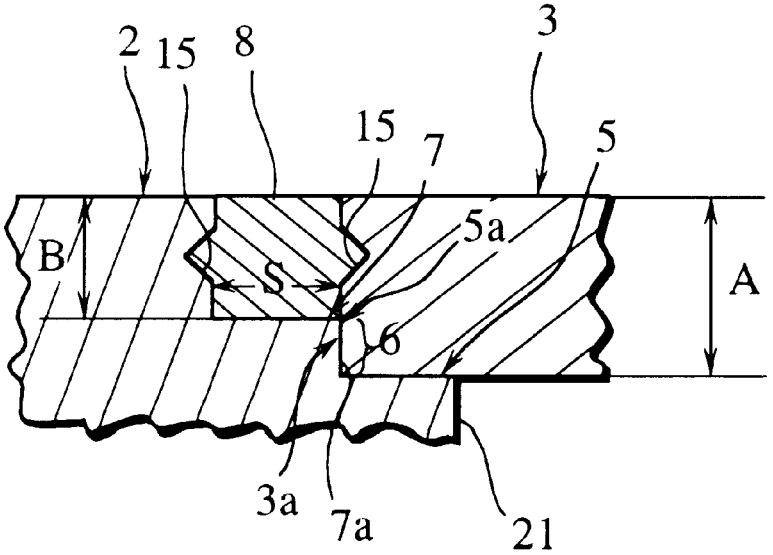
FIG. 8B is an explanatory cross-sectional view of an enlarged principal portion with a small concave groove portion on a head main body and a face body.

And, although an embodiment shown in FIGS. 8A and 8B is basically same as the embodiment shown in FIGS. 7A and 7B, different point is that the small concave groove portion 15 is also formed on the peripheral surface 3*a* of the face body 3. That is to say, the small concave groove portion 15 that the caulking member 8 gets in is formed on both of the inner peripheral surface 5*a* of the concave portion 5 and the peripheral surface 3*a* of the face body 3. In this case, the inner peripheral surface 5*a* of the head main body 2 and the peripheral portion 3*a* of the face body 3 are vertical. And, the small concave groove portion 15 may be formed only on the peripheral portion 3*a* of the face body 3 (not shown in Figures).

Although the small concave groove portion 15 is triangle in cross-section in FIGS. 7A and 7B, and in FIGS. 8A and 8B, other configurations may be used. The configurations of the small concave groove portion 15, however, need to be configurations that the caulking member 8 easily get in with plastic deformation, as from FIG. 7A to FIG. 7B, and as from FIG. 8A and FIG. 8B.

Figure 17:
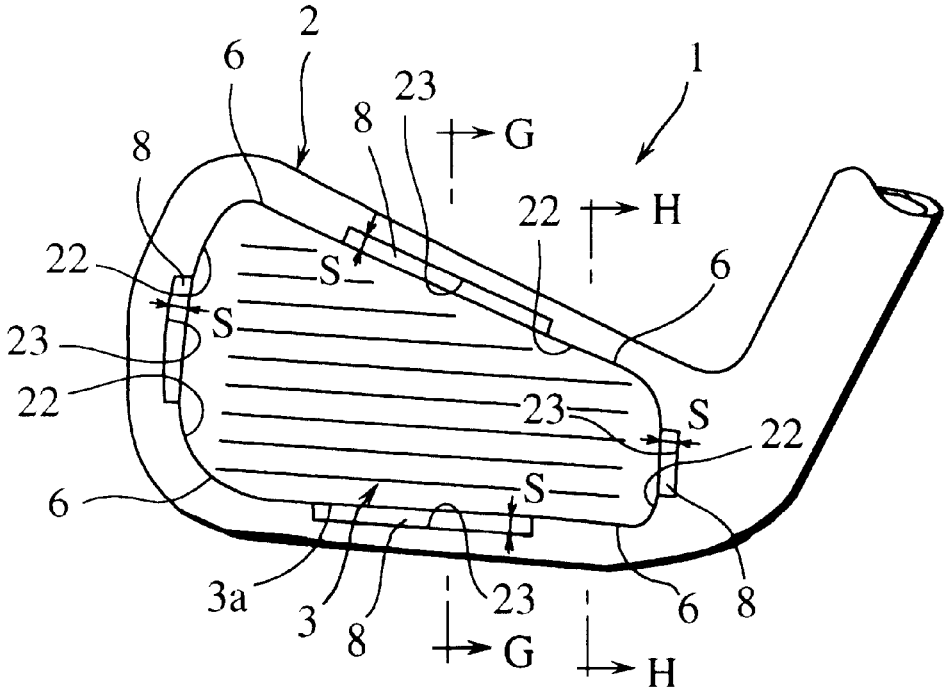
FIG. 17 is a front view of a further preferred embodiment.

Next, FIG. 16, FIG. 17, and FIGS. 18A and 18B show a further preferred embodiment in which the inner peripheral surface 5*a* of the concave portion 5 of the head main body 2 is, in a front view (as shown in FIG. 17), composed of first inner peripheral faces 22 which correspond to the peripheral surface 3*a* of the face body 3, and second inner peripheral faces 23 that are notched and apart from the peripheral surface 3*a* of the face body 3 and form aperture S to which the caulking member 8 is press-fitted. Contact areas 6 are composed of the first inner peripheral faces 22 and the peripheral surface 3*a* of the face body 3 contact each other.

Figure 18A:
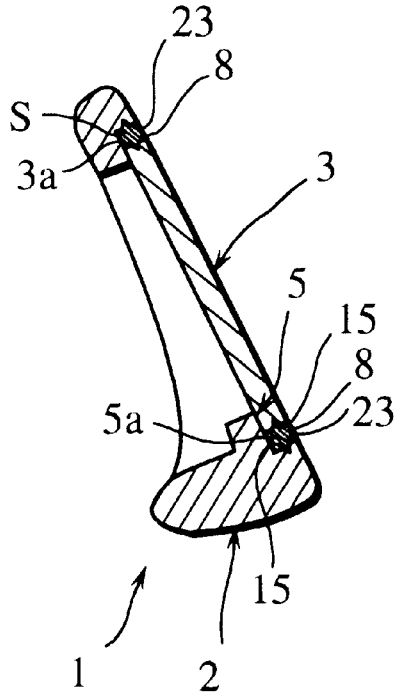
FIG. 18A is a cross-sectional view of a further preferred embodiment.
Figure 18B:
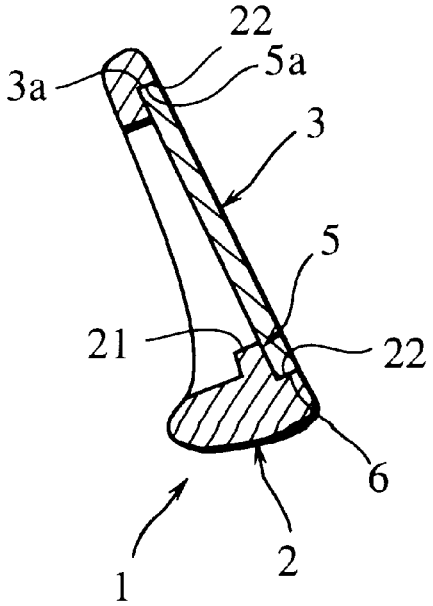
FIG. 18B is a cross-sectional view of a further preferred embodiment.

Concretely, the first inner peripheral faces 22 are formed on four corners of the inner peripheral surface 5*a* of the concave portion 5, and the contact areas 6 correspond to the first inner peripheral faces 22. And, the second inner peripheral faces 23 are formed on a part of upper side, a part of lower side, a part of a toe side, and a part of a heel side of the inner peripheral surface 5*a*. FIG. 18A is a cross-sectional view of FIG. 17 at a line G—G, and FIG. 18B is a cross-sectional view of FIG. 17 at a line H—H. As clearly shown in these FIGS. 18A and 18B, the stepped portion is not formed in the concave portion 5. And, as shown in FIG. 18A, a small concave groove portion 15 is formed on each of the inner peripheral surface 5*a* of the concave portion 5 and the peripheral surface 3*a* of the face body 3.

As materials for the face body 3, materials that are difficult to be plastically worked, for example, amorphous metal, titanium, titanium alloy, tungsten, ceramic, etc., are used. On the other hand, as materials for the head main body 2, materials that are relatively hard and of high yield point, for example, titanium, titanium alloy, etc., are used.

And, as materials for the caulking member 8, for example, brass, copper, gold, silver, stainless steel, etc. are used. That is to say, materials for the caulking member 8 are easier than the materials for the head main body 2 and the face body 3 to be plastically deformed, or of low yield point.

As described above, even if the head main body 2 and the face body 3 are made of dissimilar (different) materials each other, and the materials are difficult to be plastically deformed, the face body 3 can be certainly and firmly fixed to the head main body 2. And, in actual use, generation of looseness and gaps at the fixed part can be prevented.

Further, as shown in FIG. 3A through FIG. 8B, FIGS. 15A and 15B, and FIGS. 18A and 18B, there is an advantage that the face body 3 can be accurately positioned to the head main body 2, since the peripheral surface 3*a* of the face body 3 directly adheres (tightly fits) to the inner peripheral surface 5*a* of the concave portion 5 of the head main body 2.

Especially, there is an advantage that dislocation of the face body 3 to the head main body 2 is not generated, even if the caulking member 8 is press-fitted to the aperture S between the inner peripheral surface 5*a* and the peripheral surface 3*a* of the face body with a press method in which press position is moved along the aperture S in longitudinal direction and the caulking member 8 is press-fitted and plastically deformed sequentially. (That is to say, in a conventional construction disclosed by Japanese Patent Provisional Publication No. 8-252344, there is a disadvantage that a face body generates dislocation to the opposite side of a press position with the former-described method of moving the press position because a caulking member is placed between a peripheral surface of a face body and an inner peripheral surface of a concave portion of a head main body and they do not contact directly, this makes an aperture of the opposite side narrow, and the press is interrupted thereby. And there is another disadvantage that dislocation of the face body is generated by ununiform plastic deformation of the caulking member, and the aperture around the face body becomes ununiform thereby. These disadvantages are solved in the present invention.)

Further, even if the head main body 2 and the face body 3 are made of titanium or titanium alloy having high deformation resistance and high spring back, or made of materials never plastically deform, the golf club head can be efficiently produced with a small manufacturing apparatus (a small press machine, etc.), since the manufacturing method that the press position is moved along the aperture S can be applicable, as described above.

And, working efficiency can be improved with the caulking member 8 of which material is easier than the materials of the head main body 2 and the face body 3 to be plastically deformed. Therefore, in fixing (connecting) construction of the present invention, easy material and difficult material for plastic working are ingeniously connected.

And, moment of inertia of the golf club head 1 can be increased with the head main body 2 made of titanium or titanium alloy having low specific gravity and high strength, combination effect relating to differences among the requirement characteristics of each part of the head is effectively demonstrated. Especially, when the face body 3 is made of amorphous metal, the club head shows high repulsiveness to the ball for low elastic modulus and high strength of the amorphous metal.

And, as shown in FIG. 3A through FIG. 8B, the plastically deformed caulking member 8 gets into between the inclined aperture forming face 16 of the inner peripheral surface 5*a* of the concave portion 5 and the chamfer 9 formed on the peripheral surface 3*a* of the face body 3, or into the small concave groove portions 15 formed on the inner peripheral surface 5*a* and the peripheral surface 3*a*, resistance against falling of the caulking member 8 is enlarged, and this realizes further certain fixation.

The present invention can be applied to putter type golf club heads, as well as wood type golf club heads and iron type golf club heads. And, the present invention is appropriate for wood type and iron type golf club heads of which impact force is high when they hit golf balls, and especially, the most appropriate for wood type golf club heads which receive high impact force.

Next, examples will be described.

Figure 19A:
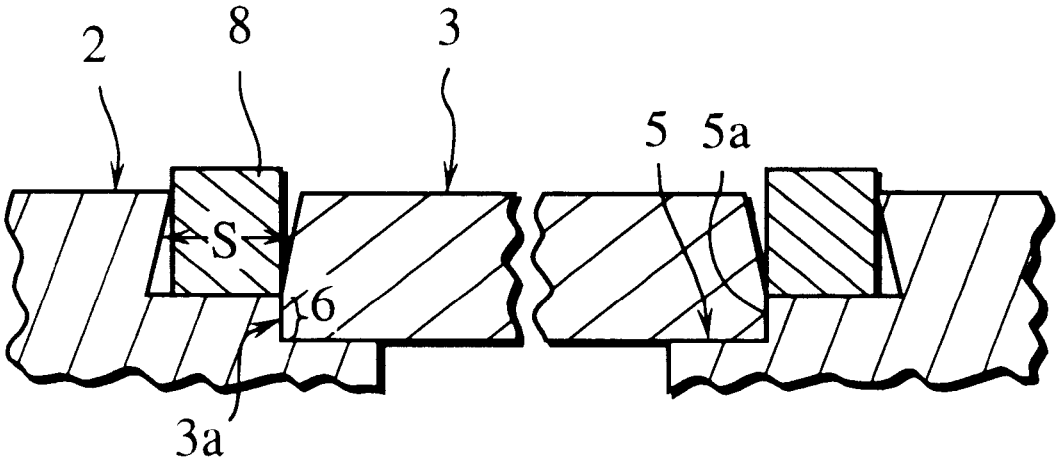
FIG. 19A is a cross-sectional view of an example.
Figure 19B:
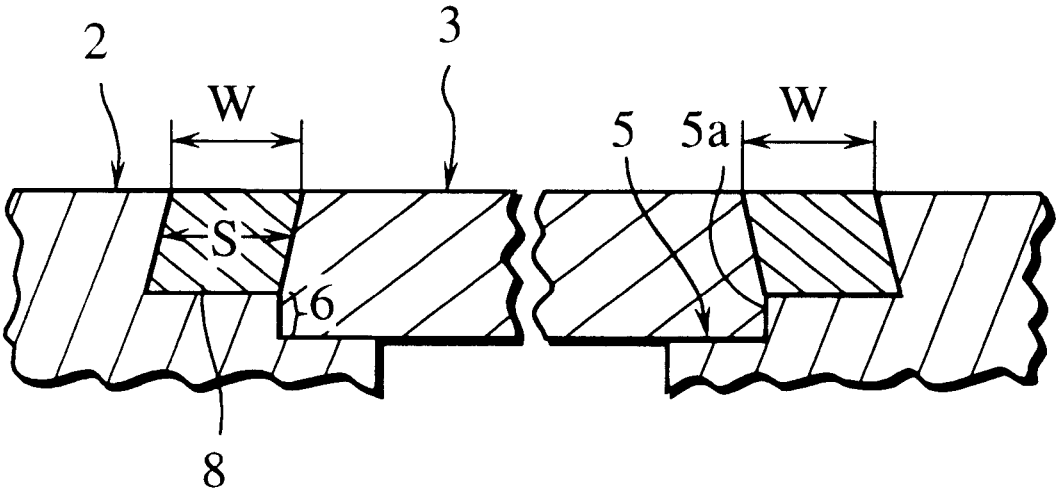
FIG. 19B is a cross-sectional view of an example.
Figure 22A:
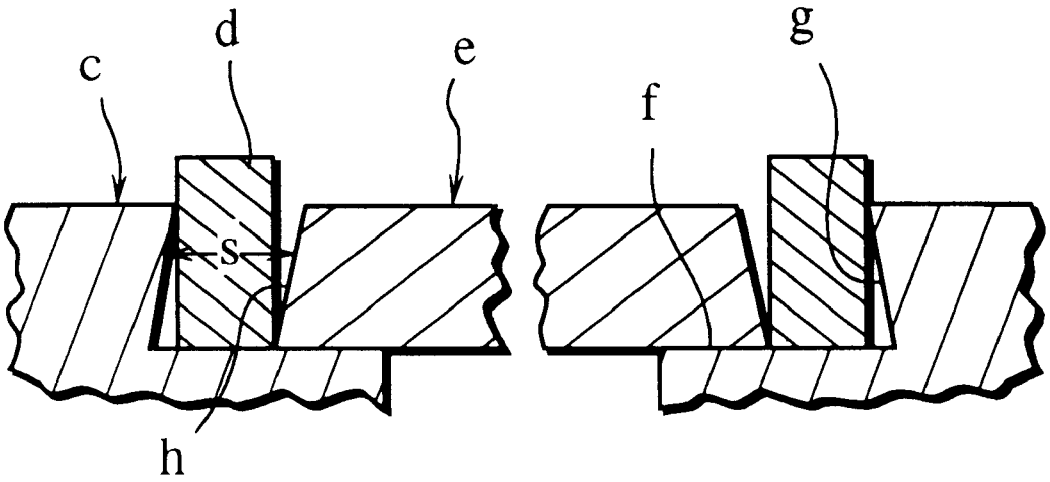
Fig.22A (PRIOR ART)
FIG. 22A is a cross-sectional view of a conventional example.
Figure 22B:
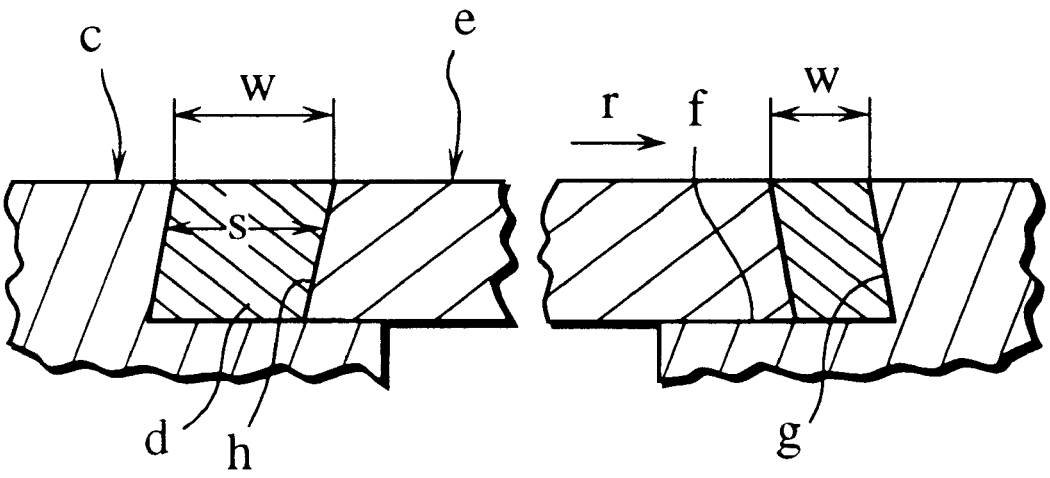
Fig.22B (PRIOR ART)
FIG. 22B is a cross-sectional view of a conventional example.

A club head of a fitting (connecting) construction as shown in FIGS. 19A and 19B is produced. And, a club head of a fitting (connecting) construction as shown in FIGS. 22A and 22B is produced as a conventional example. In these two cases, the head main body is made of 6A1-4V titanium alloy, the face body 3 is made of Zr series amorphous alloy (Zr55A1 10Ni5Cu30), and the caulking member 8 is made of brass. Sectional construction of the examples is same as FIGS. 3A and 3B. In FIGS. 22A and 22B, c represents a head main body, d represents a caulking member, e represents a face body, f represents a concave portion, g represents an inner peripheral surface, h represents a peripheral surface, and w represents a width. The face body 3 (*e*) is inserted in the concave portion 5 (*f*) of the head main body 2 (*c*), an end of the linear caulking member 8 (*d*) is placed in the aperture S, and the caulking member 8 (*d*) is spooled out and worked with press-fit plastic deformation working with moving press position in peripheral direction sequentially. In the example of the present invention, the press-fit plastic deformation working can be conducted along the entire periphery of the face body. Then, the golf club heads are finished with surface polishing as shown in FIG. 19B and FIG. 22B.

As a result, in the golf club head of the example, press working time is approximately same as press working time of a conventional golf club head made of stainless steel (SUS630, for example). Gaps are not observed between the caulking member 8 and the peripheral surface 3*a* of the face body 3, and between the caulking member 8 and the inner peripheral surface 5*a* of the head main body 2 in surface observation. And, the face body 3 does not dislocate to the head main body 2, and the width of the caulking member 8 is uniform.

In the golf club head of the conventional example, the face body e moves toward the opposite side of the press position in early stages of moving the press position, space (aperture S) for insertion of the caulking member d becomes narrow, and the press-fit plastic deformation working is interrupted. And, in a press-fit plastic deformation working with a conventional method in which the whole caulking member 8 is simultaneously pressed, the working can be completed, although extremely high pressure is necessary in comparison with the method of moving press position. Then, the club head is finished with surface polishing.

As a result, as shown in FIG. 22B, the face body e dislocates toward a direction (a direction shown with an arrow r) to the head main body c, the width w of the caulking member d becomes ununiform.

Figure 20:
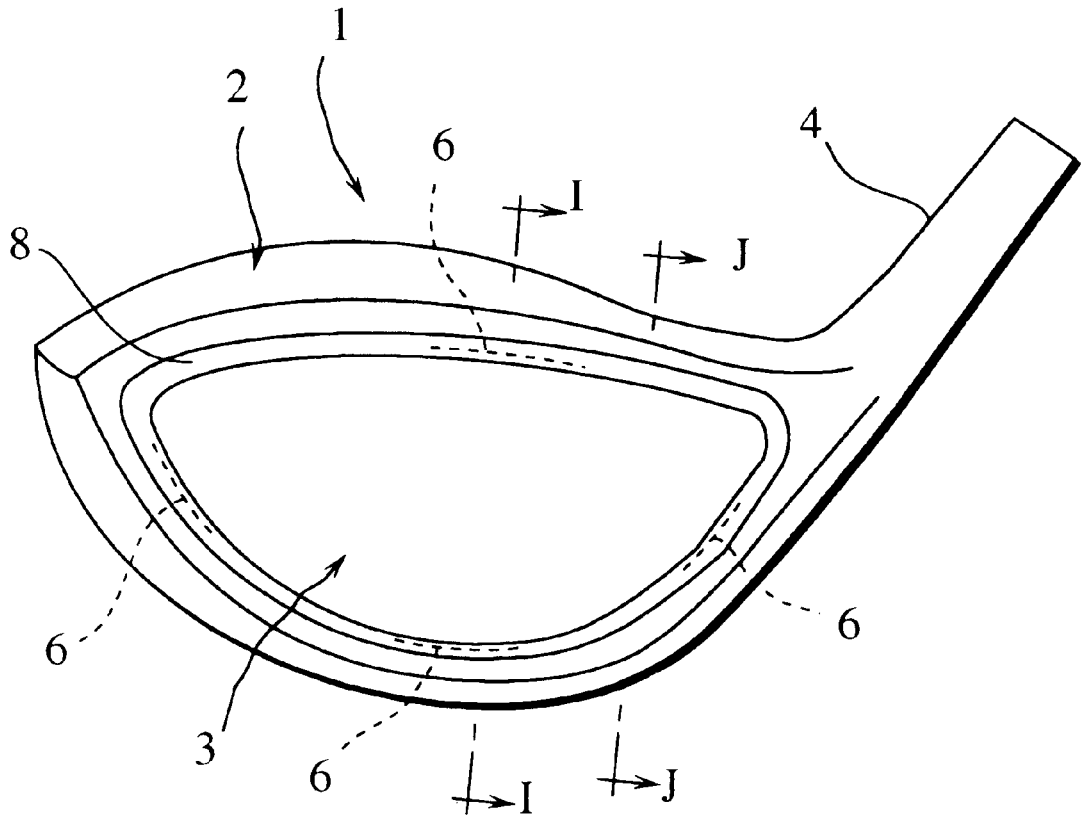
FIG. 20 is a front view of another example.
Figure 21A:
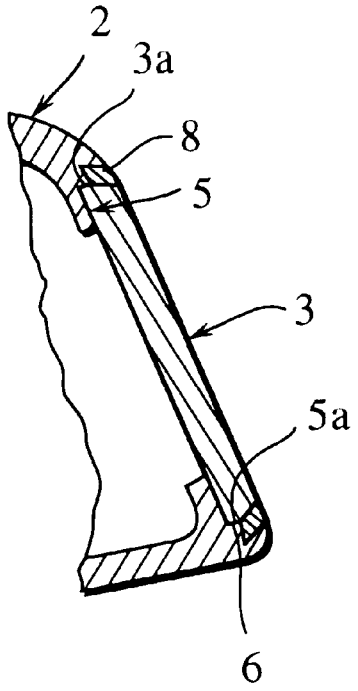
FIG. 21A is a cross-sectional view of an enlarged principal portion of another example.
Figure 21B:
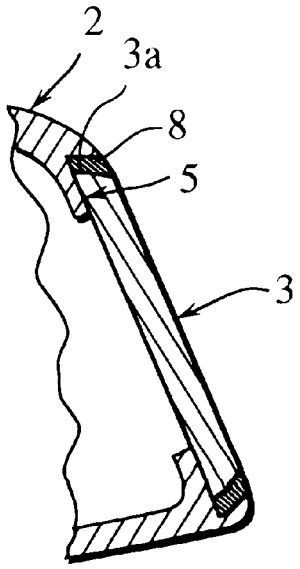
FIG. 21B is a cross-sectional view of an enlarged principal portion of another example.

And, a wood type golf club head having a fitting (connecting) construction as shown in FIG. 20, and FIGS. 21A and 21B (same as the fitting construction shown in FIG. 13, FIG. 14, and FIGS. 15A and 15B) is produced. And, a wood type golf club head having a fitting construction as shown in FIGS. 19A and 19B, and a wood type golf club head having a fitting construction as shown in FIGS. 22A and 22B, are produced. The head main body 2 is made of 6A1-4V titanium alloy, the face body 3 is made of Zr series amorphous alloy (Zr55A1 10Ni5Cu30), and the caulking member 8 is made of brass. FIG. 21A is a cross-sectional view of FIG. 20 at a line I—I, and FIG. 21B is a cross-sectional view of FIG. 20 at a line J—J.

In the golf club head of FIGS. 19A and 19B as an example of the present invention, and in the golf club head of FIG. 20 and FIGS. 21A and 21B as an example of the present invention, gaps are not observed between the caulking member 8 and the peripheral surface 3*a* of the face body 3, and between the caulking member 8 and the inner peripheral surface 5*a* of the head main body 2 in surface observation, the face body 3 does not dislocate to the head main body 2, and the width w of the caulking member 8 is uniform.

On the contrary, in the golf club head of FIGS. 22A and 22B as a conventional example, the face body e dislocates toward a direction (the direction shown with the arrow r) to the head main body c, and the width w of the caulking member d becomes ununiform.

And, actual hitting test (of 1000 hittings) with a machine for shooting balls is conducted with each golf club head. In the golf club head of the example of FIGS. 19A and 19B, and in the golf club head of the example of FIG. 20 and FIGS. 21A and 21B, there is no problem in strength of fixation, and cracks and gaps are not generated.

On the contrary, in the golf club head of the conventional example of FIGS. 22A and 22B, cracks are generated in the caulking member 8 after 574 hittings.

According to a golf club head of the present invention, even if the head main body 2 is made of difficult materials to be plastically deformed such as titanium alloy etc., and the face body 3 is also made of difficult materials to be plastically worked such as amorphous alloy etc., the face body 3 can be fixed efficiently, stably, and certainly. Further, in press-fit plastic working of the caulking member 8, the face body 3 is held by the contact area 6 as not to dislocate to the head main body 2. Therefore, the golf club head can be worked efficiently with a small press machine when the caulking member 8 is worked with press-fit plastic deformation in longitudinal direction of the aperture S sequentially. And, the face body 3 can be certainly (without dislocation) fixed to a predetermined position of a face side of the head main body 2. And, in case that the head main body 2 or the face body 3 has a small concave groove portion 15, the plastically deformed caulking member 8 gets into the small concave groove portion 15, resistance against falling of the caulking member 8 is enhanced, and further certain fixation is achieved thereby. Further, beautiful finish and high durability of the golf club head can be obtained. Moreover, the golf club head has further beauty with an external design that the caulking member 8 of uniform width surrounds the periphery of the face body 3.

And, according to the golf club head of the present invention, the face body 3 can be fixed with the minimum amount of the caulking member 8, and this makes the press-fit working of the caulking member 8 into the aperture S easy. And, the moment of inertia of the club head 1 can be increased, and the combination effect relating to differences among the requirement characteristics of each part of the head is sufficiently shown. Further, in case that amorphous metal is used as the material of the face body 3, high repulsiveness can be obtained by the low elastic modulus and the high strength of the amorphous metal.

While preferred embodiments of the present invention have been described in this specification, it is to be understood that the invention is illustrative and not restrictive, because various changes are possible within the spirit and the indispensable features.

What is claimed is:

1. A golf club head comprising:

a head main body with a front surface, the front surface suitable for receiving a face plate of thickness A, said front surface having three surfaces in a stepped relationship with each of said three surfaces successively recessed from the preceding surface, said three surfaces including, an outer surface forming the exterior surface of the front surface;

an inner peripheral surface recessed a distance B from the outer surface and having a length S, the distance between the outer surface and said face plate, an inner brim surface, for contacting said face plate, recessed a distance A-B at a right angle from said inner peripheral surface;

said face plate having thickness A inserted into said front surface and directly contacting said inner brim surface of said front surface; and a caulking member, made of a material which can be plastically deformed, contacting said inner peripheral surface and inserted between said outer surface of said front surface and said face plate so as to secure said face plate in said front surface;

wherein said distance B, the distance which said inner peripheral surface is recessed from said outer surface, is within the range of 0.3 A to 0.7 A.

2. The golf club head as set forth in claim 1, wherein the caulking member is made of a material which is easier to plastically deform than materials comprising the head main body and the face plate, the head main body is made of titanium, and the face plate is made of an amorphous metal.

3. The golf club head as set forth in claim 1, wherein the caulking member is made of a material which is easier to plastically deform than materials comprising the head main body and the face plate body, the head main body is made of titanium alloy, and the face plate is made of an amorphous metal.

4. The golf club head as set forth in claim 3, wherein said caulking member is made of a material selected from the group consisting of brass, copper, gold, silver and stainless steel.

5. The golf club head as set forth in claim 1, wherein a small concave groove is formed on a vertical surface facing a recessed area between said inner peripheral surface and said face plate, the vertical surface connected to at least one member selected from the group consisting of the inner peripheral surface and the face plate, thereby securely holding said face plate to said front surface of said head main body.

6. A golf club head comprising:

a head main body with a front surface;

the front surface suitable for receiving a face plate of thickness A, said front surface having two surfaces in a stepped relationship, said two surfaces including, an outer surface forming the exterior surface of the front surface;

an inner surface recessed from the outer surface, said inner surface having raised members intermittently formed along the boundary of said outer surface and said inner surface;

said face plate having thickness A and contacting said raised members; and a caulking member, made of a material which can be plastically deformed, contacting said inner peripheral surface and said raised members and inserted between said outer surface of said front surface and said face plate so as to secure said face plate in said front surface.

7. The golf club head as set forth in claim 6, wherein the caulking member is made of a material which is easier to plastically deform than materials comprising the head main body and the face plate, the head main body is made of titanium, and the face plate is made of an amorphous metal.

8. The golf club head as set forth in claim 6, wherein the caulking member is made of a material which is easier to plastically deform than materials comprising the head main body and the face plate, the head main body is made of titanium alloy, and the face plate is made of an amorphous metal.

9. The golf club head as set forth in claim 8, wherein said caulking member is made of a material selected from the group consisting of brass, copper, gold, silver and stainless steel.

10. The golf club head as set forth in claim 6, wherein a small concave groove is formed on a vertical surface facing a recessed area between said inner surface and said face plate, the vertical surface connected to at least one member selected from the group consisting of the inner surface and the face plate, thereby securely holding said face plate to said front surface of said head main body.

11. A golf club head comprising:

a head main body with a front surface;

the front surface suitable for receiving a face plate of thickness A, said front surface having two surfaces in a stepped relationship said two surfaces including, an outer surface forming the exterior surface of the front surface;

an inner surface recessed from the outer surface, peripheral faces including first peripheral faces intermittently formed along said inner surface and directly contacting said face plate, and second peripheral faces that are notched, intermittently formed along said inner surface and spaced from said face plate creating an aperture between said second peripheral surface and said face plate, said peripheral faces extending into said outer surface;

said face plate having thickness A inserted into said front surface and directly contacting said inner surface and said first peripheral faces;

a caulking member, made of a material which can be plastically deformed, contacting said inner surface and inserted between said second peripheral faces and said face plate to secure said face plate in said front surface.

12. The golf club head as set forth in claim 11, wherein the caulking member is made of a material which is easier to plastically deform than materials comprising the head main body and the face plate, the head main body is made of titanium, and the face plate is made of an amorphous metal.

13. The golf club head as set forth in claim 11, wherein the caulking member is made of a material which is easier to plastically deform than materials comprising the head main body and the face plate, the head main body is made of titanium alloy, and the face plate is made of an amorphous metal.

14. The golf club head as set forth in claim 13, wherein said caulking member is made of a material selected from the group consisting of brass, copper, gold, silver and stainless steel.

15. The golf club head as set forth in claim 11, wherein a small concave groove is formed on a vertical surface facing a recessed area between said inner surface and said face plate, the vertical surface connected to at least one member selected from the group consisting of the inner surface and the face plate, thereby securely holding said face plate to said front surface of said head main body.

* * * * *